US005418332A

United States Patent [19]

Moncrieff

[11] Patent Number: 5,418,332

[45] Date of Patent: May 23, 1995

[54] ELECTRICAL CABLE USING COMBINATION OF HIGH RESISTIVITY AND LOW RESISTIVITY MATERIALS AS CONDUCTORS

[76] Inventor: J. Peter Moncrieff, 408 Mason Rd., Vista, Calif. 92084

[21] Appl. No.: 70,275

[22] Filed: Jun. 1, 1993

[51] Int. Cl.[6] ..... H01B 7/00

[52] U.S. Cl. ..... 174/115; 174/126.1; 174/126.2

[58] Field of Search ..... 174/115, 126.2, 126.1

[56] References Cited

U.S. PATENT DOCUMENTS

| | | | |
|---|---|---|---|
| 3,614,300 | 10/1971 | Wilson | 174/115 |
| 3,676,576 | 7/1972 | Dubernet et al. | 174/113 R |
| 3,749,817 | 7/1973 | Shiga et al. | 174/102 |
| 3,816,644 | 6/1974 | Giffel et al. | 174/115 |
| 3,832,704 | 8/1974 | Kardashian | 174/126.2 |
| 3,867,564 | 2/1975 | Kardashian | 174/36 |
| 4,657,342 | 4/1987 | Bauer | 174/115 X |
| 4,960,965 | 10/1990 | Redmon et al. | 174/102 R |
| 5,057,646 | 10/1991 | Nichols et al. | 174/36 |
| 5,068,497 | 11/1991 | Krieger | 174/106 R |
| 5,170,010 | 12/1992 | Aldissi | 174/36 |

FOREIGN PATENT DOCUMENTS

| | | | |
|---|---|---|---|
| 11553 | 3/1910 | France | 174/126.2 |
| 3341086 | 5/1985 | Germany | 174/115 |

*Primary Examiner*—Morris H. Nimmo

[57] ABSTRACT

A structure such as a cable for carrying an electric current or voltage or signal, where one conductor employs a material of much higher resistivity than the other conductor. A method of carrying an electric current or signal that allows exploitation of the advantages of high resistivity materials while avoiding disadvantages.

20 Claims, 3 Drawing Sheets

ELECTRICAL CABLE USING COMBINATION OF HIGH RESISTIVITY AND LOW RESISTIVITY MATERIALS AS CONDUCTORS

BACKGROUND OF THE INVENTION

This invention relates to electrical wire and cable, and to means for carrying electric current and voltage and signals.

A completed electric circuit requires at least two paths from any point, a forward (outgoing) current path and a return current path. Thus a cable must have at least two distinct conductors, to accommodate these two paths, if that cable is to serve as the sole connecting means between distinct electrical circuits, or between nodes, junctions, terminals, elements, etc. of the same circuit.

These two conductors in a cable have been of approximately equal resistance, within an order of magnitude. This is appropriate to the traditional model of a cable's function, as being part of a current loop; the forward and return paths are part of the same loop, so it would seem to make sense to make all parts of that loop approximately equal in resistance. This is also appropriate to the modern model of a cable's function, as being a paired conductor guide for the electromagnetic wave in space.

Based on the above two models of how an electrical cable functions, the conventional wisdom of making the two conductors approximately equal in resistance makes sense. However, the present invention also incorporates a third model of how an electrical cable functions. This third model is especially relevant in signal carrying applications, and especially where the signal connection has unbalanced topology.

In this third model, the conductor for the forward path carries all the signal information. In contrast, the conductor for the return path carries no signal information, but instead serves as a fixed reference baseline. Both electrical circuits (or nodes, junctions, terminals, elements, etc.) connected by the cable rely on this so-called return path conductor as a common reference baseline. The amplitude of the electrical signal, as sensed by both, is defined relative to this common baseline (which is usually, though not necessarily, fixed at zero or ground potential).

Thus, under this third model, it is advantageous to make the return path (i.e. reference baseline) conductor have as low resistance and impedance as possible, at all signal frequencies of interest. Conversely, the forward path (i.e. signal carrying) conductor can simultaneously have a relatively high resistance. So long as the return path conductor has sufficiently low resistance to function as an accurate common reference baseline, the impedances of both circuits, nodes, etc. are defined relative to it, and the resistance of the forward path conductor will merely add to these other impedances in what can be a benign manner.

The present invention offers an electrical cable design in which the forward path conductor has a much higher resistance than the return path conductor. In one preferred embodiment, especially useful for carrying signals, the resistance of the forward path conductor is approximately 10,000 times higher than the resistance of the return path conductor. This design enables the present invention to employ materials of high resistivity for the forward path conductor, while employing materials of low resistivity for the return path conductor. This allows the use of widely diverse materials for the two conductors of the cable, each material being chosen for its optimum capability in performing the divergent functions of the forward versus the return conductor.

DESCRIPTION OF PRIOR ART

Prior art has limited itself to using materials of similar conductivity and resistivity for both conductors carrying a single current or voltage or signal in a basic cable; these two conductors could be considered to function as the forward and return path conductors for that single voltage, current, or signal. The materials have generally been selected for uniformly low resistivity, e.g. the common conductive metals.

The resistance of a conductor is a function not only of its material, but also of its dimensions. In contrast, resistivity is resistance per unit dimension, and as such it is a property of only the material itself, irrespective of the dimensions of the conductor employing this material.

Some prior art electrical cables U.S. Pat. Nos. 3,614,300; 4,657,342 and 5,057,646 have employed various conductors made of the same material but having different diameters. Thus, these conductors have differing resistances. But they all have the same resistivity; all these conductors employ material with the same resistivity.

Some prior art electrical cables French Patent 11,553 and U.S. Pat. Nos. 3,676,576 and 3,832,704 have employed various conductors made of different materials, but these different materials nonetheless have had similar resistivities to one another. These different materials have all been metals having a resistivity equal to or lower than tin; this includes copper, aluminum, steel, gold, silver, iron, tungsten, molybdenum, beryllium, nickel, permalloy, platinum, tin, etc. The ratio of the highest resistivity material in this group (tin) to the lowest (silver) is merely 6.83, less than one order of magnitude. Materials with a resistivity equal to or lower than tin certainly all qualify as low resistivity materials. Thus, the conductors in these prior art cables have employed only low resistivity materials.

Some prior art electrical cables U.S. Pat. No. 4,657,342 have employed only one material for the various conductors carrying a current or voltage or signal, and have employed a different material such as steel to serve only as a tensile support member for the cable, not as a conductor.

Some prior art electrical cables German Patent 3,341,086 and U.S. Pat. No. 5,057,646 have employed various conductors made of different materials to carry different currents or voltages or signals. However, these different materials, perhaps having substantially divergent resistivities, were employed only for different functions of the cable and for different currents or voltages or signals. All of the conductors participating in carrying any single first current or voltage or signal have been made from the same first material, while any additional conductors made from a different second material have been assigned to handle a different second current or voltage or signal, and indeed to perform a different function, such as heating or shielding those distinct cable conductors doing the actual carrying of a current or voltage or signal. Additionally, function aside, even the structure of this prior art recites its structural elements as "conductive shield", "shielding means", "heating wires", etc., not as conductors for the current or voltage or signal of interest being carried by the cable structure. In no case did this prior art contemplate a structure for carrying a single current or voltage or signal, this structure employing different materials of substantially divergent resistivity.

Thus, all prior art electrical cables have shared the common limitation, that both conductors required for carrying a single current or voltage or signal employ the same material or materials having similar resistivities.

Recent prior art has developed high resistivity materials for use in conducting signals. Some of these materials, for example carbon, yield some advantages, because they can be manufactured as thinner strands with a more homogenous structure than metals can be.

However, this recent prior art has still limited itself in the same way, by employing conductors of similar resistivity for the forward path and return path functions of a cable. In this case, both conductors have been made of similarly high resistivity material, and thus have similarly high resistance.

The basic limitation of all this prior art, i.e. having similar resistivity for both conductors, works satisfactorily when the resistance is very low. But when the resistance becomes appreciably high, this basic limitation imposes disadvantages that degrade performance, especially in signal carrying applications.

In particular, a high resistance return path conductor fails to fulfill one of its key functions. It cannot act as a common reference baseline for both circuits, nodes, etc., between which the cable is carrying a signal.

This failure imposes the severest degradations when the signal-and the circuit topology is unbalanced, since then the signal is defined relative to the common reference baseline established by the return path conductor. If the resistance of the return path conductor is even a significant small fraction of the impedances of the circuits, then the cable will fail to provide the same common reference baseline at both ends, and so the signal will fail to be accurately defined at both ends, accordingly becoming distorted at one end relative to the other. For example, significant resistance in the return path conductor could produce a voltage drop along the conductor, so that the instantaneous voltage would differ at both ends of the conductor, making the reference baseline instantaneously different at both ends, and thereby distorting any voltage or signal that is defined relative to the common reference baseline.

This failure can also impose some degradations, perhaps to a lesser degree, on balanced signals between balanced circuit topologies. Balanced signal receivers do not have perfect common mode rejection (especially at high frequencies), and still benefit from an accurate common reference baseline. Furthermore, many balanced receivers are divided into two halves, with each half sensing its half of the input signal relative to a common reference baseline, before the two halves are then combined; an inaccurate common reference baseline will favor one signal half over the other (since these halves are opposite in polarity), thereby causing an error that will not be balanced out.

Shielded coaxial cables of prior art U.S. Pat. Nos. 3,749,817; 3,816,644; 4,960,965; 5,068,497 and 5,170,010 have sometimes used the shield not only for a shielding function, but also for two further functions, as a return path conductor, and as a common reference baseline. However, this design still presents problems. For example, if the environment has hostile fields which dictate shielding in the first place, then the common reference baseline should be protected from these hostile fields by being within the shield (as in a twinaxial cable), rather than being exposed to them by being on the outer shield. The shield's function in sinking intrusive, externally induced signals to ground should not be comingled with the return path conductor's function of acting as a clean common reference baseline, since this invites comingling of the intrusive external signals into what should remain a fixed common reference baseline.

Prior art also has employed multiple separate return path conductors to a common chassis or circuit where there are multiple forward path conductors carrying multiple signals. This has had the disadvantage that unwanted current loops, such as ground loops, can circulate among the several separate return path conductors, thereby contaminating the function of these conductors as an accurate reference baseline.

OBJECTS AND ADVANTAGES

Accordingly, the present invention breaks with the limitation shared by all prior art, that the forward path and return path conductors, distinct from a shield, in a structure for carrying a single current or voltage or signal employ materials of similar resistivity. One object of the present invention is to offer a structure such as a cable for carrying an electrical current or voltage or signal in which the forward path conductor employs a material whose resistivity differs significantly from the material employed in the return path conductor, by at least an order of magnitude.

A further object of the present invention is to offer an electrical cable in which the forward path conductor employs a high resistivity material, with its attendant advantages, while the return path conductor employs a low resistivity material, in order to obtain accurate functioning as a common reference baseline.

A further object of the present invention is to exploit the advantages of high resistivity materials, such as structural homogeneity and strand thinness, for carrying a signal, without sacrificing the advantages of low resistivity materials for establishing a common reference baseline for the circuits, nodes, etc. between which the signal is being carried. Some high resistivity materials, for example carbon, can be manufactured as thinner strands with a more homogenous structure than metals can be. Thinner strands with a more homogenous structure can be advantageous in handling signals more accurately. Multiple thinner strands have more skin area, hence can exhibit superior performance at high frequencies. A more homogenous structure presents fewer unwanted crystal or structural boundaries and impurities (unwanted because they can cause nonlinearities in the signal being carried).

A further object of the present invention is to extend this design principle to shielded cables, by providing two conductors protected by shielding, comprising a high resistivity conductor for the forward signal path and a low resistivity conductor for the common reference baseline.

A further object of the present invention is to separate the function of the shield from the common reference baseline function, by having the return path conductor be distinct from the shield, and advisedly further by not having the shield connected in common with the return path conductor simultaneously at both ends of the cable, which also has the further advantage of avoiding circulating current loops between the shield and return path conductor.

A further object of the present invention is to provide a cable design for a plurality of signals, and/or for the two halves of a balanced signal, by providing an appropriate plurality of forward path conductors employing high resistivity material, and at least one return path conductor employing low resistivity material.

A further object of the present invention is to provide a single common reference baseline for a cable carrying a plurality of signals, where appropriate for the circuits between which the signals are being carried. This has the advantage of avoiding unwanted circulating current loops among a plurality of separate return path conductors, which would interfere with their accuracy as a reference baseline.

A further object of the present invention is to extend these design principles to other means, known to the art, of carrying electrical current or signals. For example, the forward path traces on a printed circuit board could employ high resistivity material, while the return path traces defining a common reference baseline could employ low resistivity material.

DESCRIPTION OF PREFERRED EMBODIMENTS

Figure 1A:
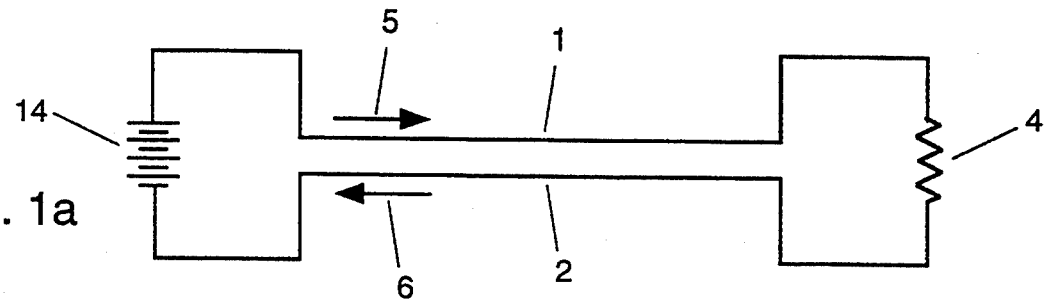
FIG. 1*a* schematically shows a current loop model of a basic electric circuit with a DC source.
Figure 1B:
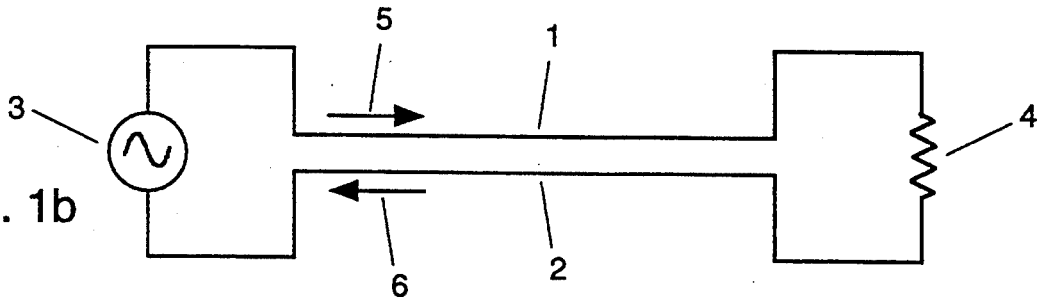
FIG. 1*b* schematically shows a current loop model of a basic electric circuit with an AC source.
Figure 2:
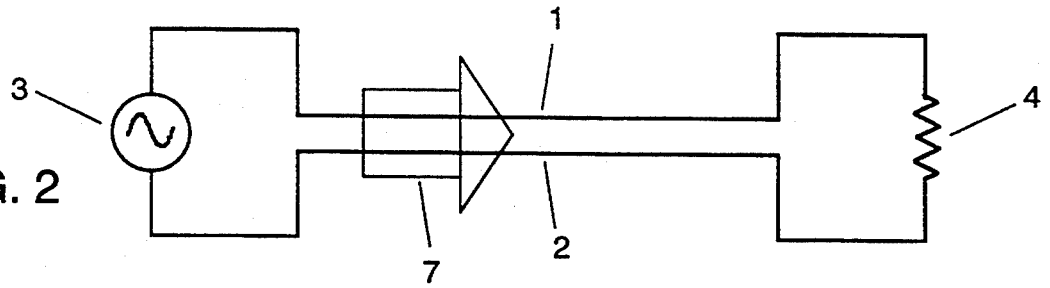
FIG. 2 schematically shows an electromagnetic wave propagation model of a basic electric circuit.
Figure 3:
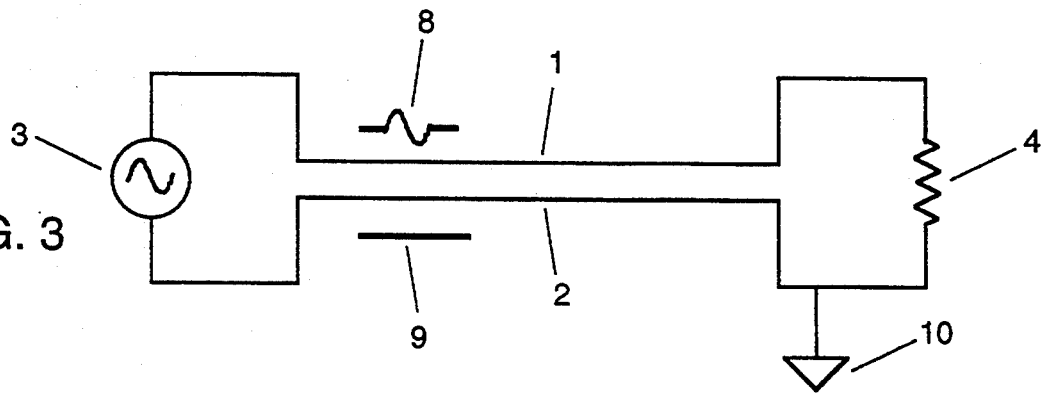
FIG. 3 schematically shows a common reference baseline model of a basic electric circuit.

FIGS. 1 through 3 illustrate three models of an electrical cable's functions, which are pertinent to the present invention.

FIG. 1*a* shows a basic electrical circuit, comprising a DC source 14 connected to a load 4. In order for the circuit to be complete, two conductors 1,2 are required to connect the DC source to the load. By convention, the direction of current flow around the circuit is in the direction indicated by arrows 5,6. By convention, conductor 1 may be called the forward path conductor, since it carries the current from the source to the load, and conductor 2 may be called the return path conductor. Conductors 1 and 2 may be brought together and regarded as an electrical cable that connects the source to the load, and carries current both to the load and back again.

FIG. 1*a* shows the traditional current loop model of a cable's function. Note that, under this model, there is no reason to make the resistance or resistivity of conductor 2 any different from what has already been established for conductor 1, since they are both in series as part of the same loop; if conductor 1 were to have high resistivity for some reason, then conductor 2 could also have high resistivity.

FIG. 1*b* shows the same circuit and the same cable as FIG. 1*a*, except that the source is an AC source 3 instead of a DC source. The same conventions may be applied for direction of current flow, indicated by arrows 3,4, and for describing conductor 1 as the forward path conductor and conductor 2 as the return path conductor.

FIG. 2 shows the modern model of a cable's function, in which an electromagnetic wave, travelling in space, is guided by the pair of conductors 1,2, in the direction shown by arrow 7. Note that, under this model, there is also no reason to make the resistance or resistivity of conductor 2 any different from what has already been established for conductor 1, since they are both joint and equal participants in guiding the electromagnetic wave; if conductor 1 were to have high resistivity for some reason, then conductor 2 could also have high resistivity.

FIG. 3 shows a third model of a cable's functions. This third model is crucial to the present invention's departure from and distinction from prior art. For simplicity, FIG. 3 shows a cable carrying a voltage-based signal, and in an unbalanced topology circuit. In the FIG. 3 model, the forward path conductor 1 carries the entire signal, shown as 8, which can swing both positive and negative. In contrast, the return path conductor 2 carries no signal at all, shown as 9, not even on a return path part of a circuit loop.

The function of the return path conductor 2 is different in this FIG. 3 model than in the model of FIGS. 1 and 2. In the FIG. 3 model, the function of the return path conductor is to have a fixed, unchanging voltage level, and to present this voltage level equipotentially at both the source and load ends of the cable. This fixed, equipotential voltage level acts as a common reference baseline for the circuits, nodes, etc. at both ends of the cable, in this case for signal source 3 and signal receiver/load 4. The source and receiver both define the amplitude of their respective signals relative to this common reference baseline. This reference baseline can be, but is not necessarily, zero volts, and zero volts can be conveniently secured by an optional ground connection or connections 10.

Under this FIG. 3 model, if conductor 2 fails to keep an equipotential common reference baseline at both ends of the cable, then the signal sensed by receiver/load 4 will be distorted relative to the defined signal sent by source 3. In order to be equipotential at both ends, conductor 2 cannot be allowed to have significant voltage drop along its length. This means that conductor 2 must have low resistivity and low resistance, and low impedance at all frequencies of interest.

In contrast, forward path conductor 1 can have relatively high resistivity and resistance. Under the FIG. 3 model, conductor 1's impedance merely adds to the source impedance of signal source 3 and the load impedance of receiver/load 4. Conductor 1's impedance can be significant compared to these source and load impedances with little ill effect, or at least with linear and predictable effects, which can also be compensated for.

Thus, under the FIG. 3 model, the advantages of high resistivity conductor mate dais, such as structural homogeneity and thin stranding, can be exploited for conductor 1—provided that a low resistivity, low resistance conductor material is employed for conductor 2, in order to insure accuracy of the common reference baseline. The present invention offers a cable design based on this model.

Note that, under this FIG. 3 model, there is ample reason to make the resistance or resistivity of conductor 2 different from what has already been established for conductor 1, since conductor 2 must function as an accurate, equipotential common reference baseline. If conductor 1 were made from high resistivity material for some reason, then conductor 2 should nevertheless have low resistivity and resistance and impedance. Thus, the present invention breaks with and is distinct from prior art, where both conductors 1 and 2 have been made from materials with similar resistivity and have had similar resistance.

Similar considerations apply to a cable carrying a plurality of signals or balanced signals, via a plurality of separate conductors. Many balanced topology signal receivers are made in two complementary halves, but each half still senses its signal input relative to a reference baseline, before the outputs from the two halves are combined, so the reference baseline must still be constant, equipotential, and uncontaminated.

Figure 4:
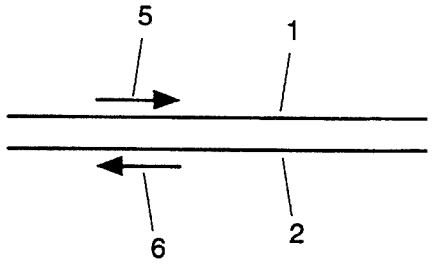
FIG. 4 schematically shows a basic two conductor cable constructed in accordance with prior art.

FIG. 4 shows schematically a simple two conductor cable of prior art. Prior art has been limited to making the two conductors 1,2 of materials having similar resistivity. The physical construction of the cable may be simply two independent conductors, or two conductors side by side, or two conductors as a twisted pair, or two conductors jacketed in common, etc.

Figure 5:
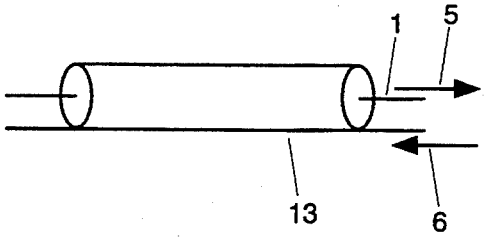
FIG. 5 schematically shows a basic coaxial shielded cable constructed in accordance with prior art.

FIG. 5 shows schematically a coaxial cable of prior art. Conductor 1 is enclosed by a shield 13, and shield 13 is connected at both ends. Shield 13's primary function is to drain away the intrusions of external fields (usually to ground), thereby protecting conductor 1 from these fields. Shield 13 also is sometimes given a secondary function, as the return path conductor, similar to return path conductor 2 in FIG. 3. However, shield 13 does not work well in the further function of common reference baseline, for those applications where a shield is needed in the first place. The external fields present in such applications will generate voltages within any shield having finite impedance, and these voltages will then contaminate the shield's function as an equipotential reference baseline for the signal carried by conductor 1; thus, the signal in conductor 1 will still be contaminated by the external fields.

Figure 6A:
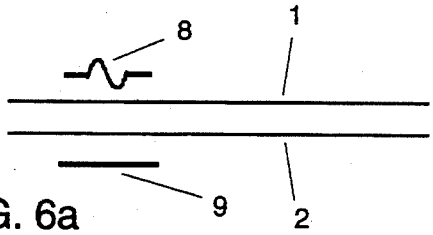
FIG. 6*a* schematically shows a basic two conductor cable constructed in accordance with the present invention.

FIG. 6*a* shows schematically the present invention in its simple form, as a simple two conductor cable. The present invention can employ materials having drastically different resistivity in the two conductors 1,2, and the two conductors 1,2 can have drastically different resistance. In one preferred embodiment of the present invention, the resistivity and resistance of conductor 1 is approximately 10,000 times higher than that of conductor 2.

The present invention encompasses either conductor 1 or conductor 2 being the conductor employing higher resistivity material, and also encompasses either conductor 1 or conductor 2 being nominally called the forward path conductor, and either being nominally called the return path conductor. The physical construction of the present invention's cable may be simply two independent conductors, or two conductors side by side, or two conductors as a twisted pair, or two conductors jacketed in common, etc.

It should be understood that elements such as conductor 1, conductor 2 in this specification are often shown as schematic or functional representations of physical embodiments. The physical embodiments of these schematic or functional representations may take any form known to the art. For examp0le, conductor 1 may be physically realized as a plurality of conductive strands, constituting a conductor set, and these strands can have varying cross sections, sizes, shapes, etc.

Figure 6B:
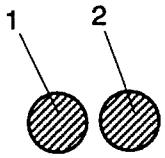
FIGS. 6*b* and 6*c* pictorially show a basic two conductor cable constructed in accordance with the present invention, in cross sectional view.
Figure 6C:
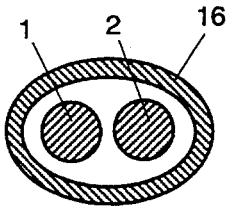

FIGS. 6*b*–6*c* show pictorial equivalents to the FIG. 6*a* schematic representation, taking the present invention as shown in FIG. 6*a* and applying it to various physical cable construction techniques known to the art, as discussed in the previous three paragraphs.

FIG. 6*b* shows in cross section two independent conductors 1 and 2, adapted for carrying the forward and return paths of a single electrical current or voltage or signal, in accordance with the above stated descriptions and objects of the present invention.

Incidentally, if two conductors are adaptable for carrying the forward and return paths for a single electrical current or voltage or signal, it logically follows structurally that these two conductors are necessarily separated from each other by a distance greater than zero, so they are not in mutual electrical contact over their length. This separation distance in turn logically implies a dielectric between the two conductors, the dielectric being either implicit (such as space or air) or explicit (such as insulation between conductors, or around one or more conductors). Thus, FIG. 6*b* does not need to show explicit insulation as an element. In accordance with the above descriptions of FIG. 6*a*, the FIG. 6*b* embodiment could utilize any of the structural devices known to the art for making conductors 1 and 2 adaptable for carrying the forward and return paths for a single electrical current or voltage or signal, by keeping conductors 1 and 2 separated; such devices could include members suspending the conductors, spacers separating the conductors, or an explicit dielectric.

Similarly, FIG. 6*c* shows in cross section conductors 1 and 2 jacketed in common, in accordance with the above descriptions. A dielectric jacket 16 encloses both conductors 1 and 2. As before, in accordance with the above descriptions of FIG. 6*a*, the FIG. 6*c* embodiment could utilize any of the structural devices known to the art for making conductors 1 and 2 adaptable for carrying the forward and return paths for a single electrical current or voltage or signal, by keeping conductors 1 and 2 separated; such structural devices could include members suspending the conductors, spacers separating the conductors, or an explicit dielectric It is contemplated that there might be advantages to conductor sets employing a plurality of strands, those strands perhaps employing various materials among them, or even a combination of materials in one strand, perhaps some being of low resistivity and some being of high resistivity. Thus it is understood that conductor 1 and/or conductor 2 can each employ a plurality of conductor strands, employing various materials, and arranged in various geometries. In particular, it might be beneficial for conductor 2 to employ both a low resistivity material (for its low resistance at DC and low frequencies), and also a high resistivity material (for its structural homogeneity, fine stranding, and large skin area, which would be advantageous in other ways, especially at very high frequencies). In this case, conductor 2 would still employ a low resistivity material, but would not employ exclusively a low resistivity material. Conductor 1, on the other hand, might work optimally by employing only high resistivity materials, except perhaps where low resistivity materials are required at locations appropriate for terminating, connecting, or interfacing the conductor to other circuits, nodes, etc., for example, a pure carbon conductor cannot be soldered directly to a circuit, but instead requires termination with low resistivity metal clips at each end.

FIG. *7a* shows schematically one preferred embodiment for a simple shielded cable, designed in accordance with the present invention. The geometry is not coaxial, but rather twinaxial, with both forward path conductor 1 and return path conductor 2 enclosed by shield 13. Thus, the reference baseline function of conductor 2 is protected by shield 13 from contamination by external fields. As in FIG. *6a*, conductor 1 can employ a high resistivity material, while conductor 2 employs a low resistivity material. Shield 13 employs a low resistivity material, so it can be effective at draining away the effects of external fields. If shield 13 is connected in common with conductor 2, as FIG. *7a* shows, then it is advisable to not connect it simultaneously at both ends of the cable. This prevents shield 13 from also assuming a secondary function as a common reference baseline, and it also prevents unwanted circulating current loops between shield 13 and conductor 2. FIG. *7b* shows the FIG. *7a* embodiment in pictorial form, in cross sectional view. In accordance with the description of FIG. *7a*, conductors 1 and 2 are enclosed by shield 13.

It is understood that the present invention is also applicable to a coaxial cable geometry such as shown in FIG. 5. For example, an alternative embodiment for FIG. 7 could utilize two coaxial cables: one coaxial cable would protect common reference baseline conductor 2 in a shield 13 (both employing low resistivity material), and the second coaxial cable would protect forward path or signal conductor 1 in a shield 13 (conductor 1 employing a high resistivity material and shield 13 employing a low resistivity material). FIG. *7c* shows this alternative embodiment in pictorial form, in cross sectional view. In accordance with the above description of this alternative embodiment, conductor 2 is enclosed by its own shield 13. Likewise, conductor 1 is enclosed by its own shield 13.

Figure 7A:
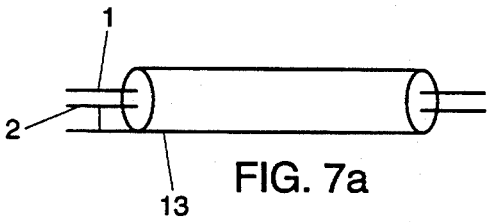
FIG. 7*a* schematically shows a basic two conductor shielded cable constructed in accordance with the present invention.
Figure 7B:
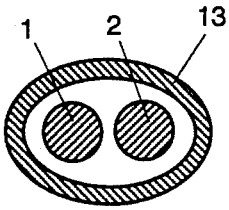
FIG. 7*b* pictorially shows a basic two conductor shielded cable constructed in accordance with the present invention, in cross sectional view.
Figure 7C:
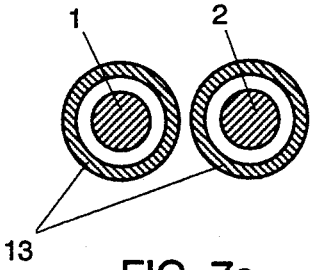
FIG. 7*c* pictorially shows an alternative embodiment of a basic two conductor shielded cable constructed in accordance with the present invention, in cross sectional view.

The present invention also encompasses multiples of the structures shown in FIGS. 6, 7, and 5. These multiples can be used to carry different electric currents or voltages or signals, or balanced signals, or signals that are alike but perhaps differ in ways such as phase.

Figure 8:
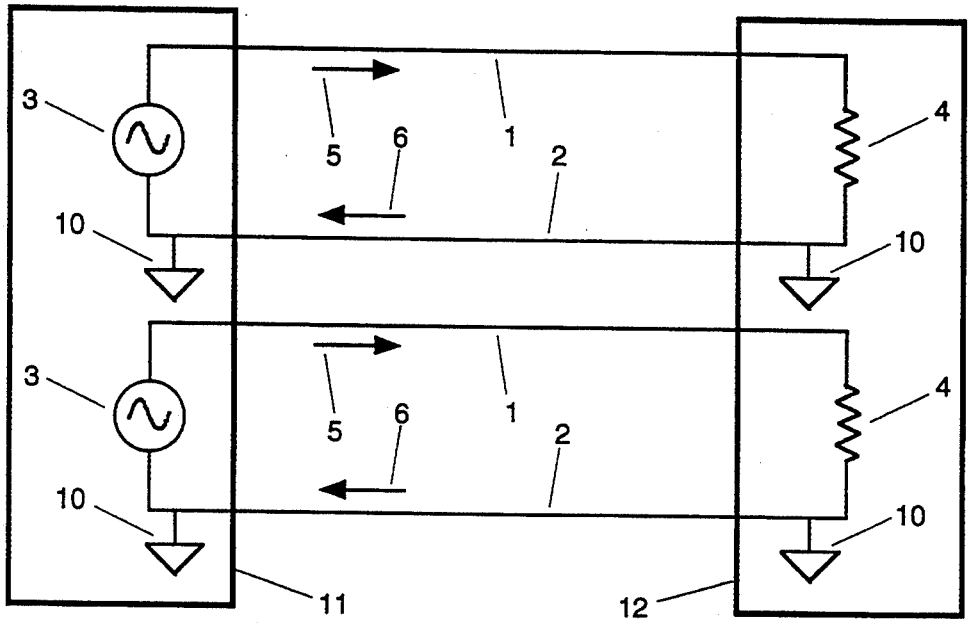
FIG. 8 schematically shows a multiple conductor cable constructed in accordance with prior art, employed between a source and receiver.
Figure 9A:
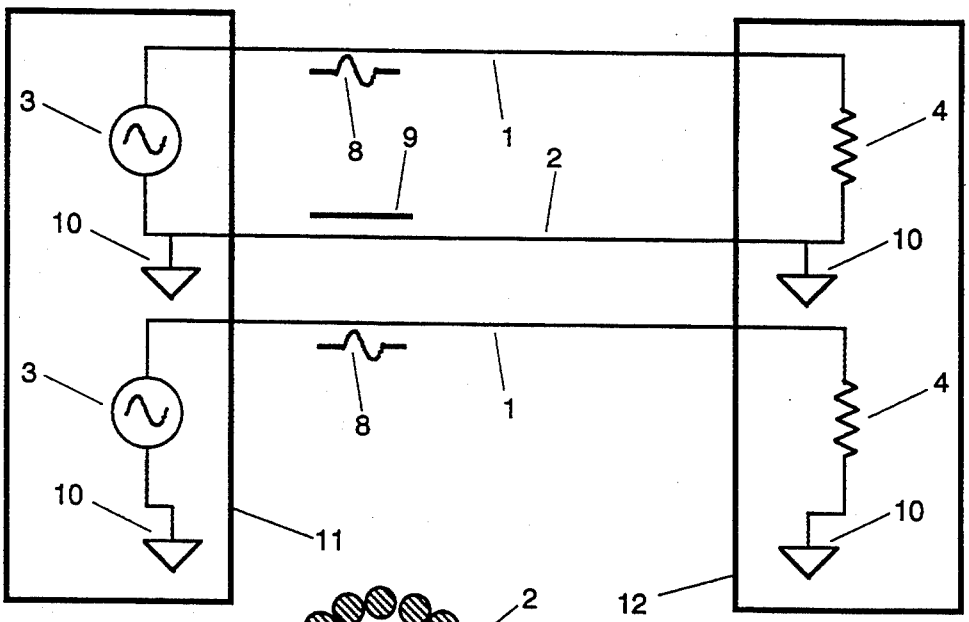
FIG. 9*a* schematically shows a multiple conductor cable constructed in accordance with the present invention, employed between a source and receiver.
Figure 9B:
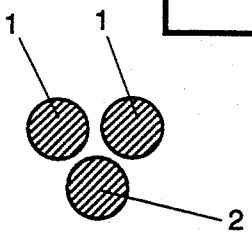
FIG. 9*b* pictorially shows a multiple conductor cable constructed in accordance with the present invention, in cross sectional view.

In addition to multiples of the structures shown in FIGS. 6, 7, and 5, the present invention offers a further structure for certain multiple conductor applications, based on the same considerations of the FIG. 3 model that have already been elucidated. FIG. 8 shows how prior art has used cables to carry multiple signals from a multi-channel, single chassis source 11 to a multi-channel, single chassis receiver 12. Typically, such sources and receivers connect the return path, reference baseline side of all signals to a common point, which is often (though not necessarily) a circuit ground 10. Prior art's cable design for connecting such sources and receivers has included multiple separate return path conductors 2, usually one for each forward path conductor 1, as shown in FIG. 8. However, this has the disadvantage that unwanted circulating current loops can develop among these multiple return path conductors 2, and among the chassis and internal wiring making the common connections to grounds 10 in the source 11 and receiver 12. These unwanted circulating current loops in turn contaminate the function of the return path conductor(s) 2 as an equipotential, pure, constant common reference baseline, as required by the FIG. 3 model.

To cure this problem, the present invention offers the cable structure shown in FIG. *9a* for such applications. As shown in FIG. *9a*, the present invention offers multiple separate conductors 1 to handle the multiple separate signals as required, but only one conductor or conductor set 2 to act as a common reference baseline connecting source 11 to receiver 12. By eliminating a plurality of separated conductors 2, the present invention eliminates the unwanted circulating current loops, thereby allowing conductor 2 to fulfill its function as a common reference baseline without contamination. FIG. *9b* shows the FIG. *9a* embodiment in pictorial form, in cross sectional view. In accordance with the above description of FIG. *9a*, two conductors 1 and single conductor 2 are grouped as a cable structure.

If a shield or shields are required for an application such as FIGS. *9a–9b*, each shield could be implemented as shown in FIG. 7, i.e. not being connected simultaneously at both ends in common with reference baseline conductor 2. There could be a single shield around a plurality or all of the conductors 1,2 shown in FIGS. *9a–9b*, or individual shields for each conductor 1 or 2.

There are many possible geometric configurations for arranging conductors 1,2, or conductor sets 1,2, or multiples of conductor 1 or 2. The present invention encompasses all such configurations known to the art.

Figure 10:
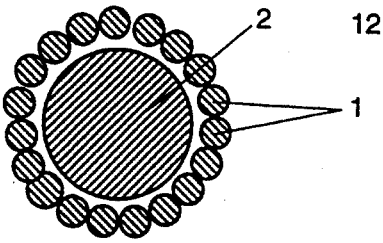
FIG. 10 shows a cross sectional view of one preferred arrangement of conductors in a cable, constructed in accordance with the present invention.

One preferred geometric arrangement is shown in FIG. 10 in cross sectional view. Multiple conductors 1, or multiple strands constituting conductor set 1, are shown arranged peripherally around conductor 2 or conductor set 2. In most applications, conductor 2 will be at ground potential. Thus, FIG. 10 shows the conductor that is at ground potential enclosed by the conductor(s) carrying the signal (s). This is distinct from prior art, where the conductor(s) carrying the signal(s) are enclosed by the conductor at ground potential. It is contemplated that there might be advantages to this distinctive arrangement of the present invention.

This FIG. 10 arrangement also follows naturally from the relative diameters likely to be employed for conductor 1 versus conductor 2. Conductor 2 would likely employ large size strands of metal, this being a low resistivity material, while conductor 1 would likely employ small size strands of a high resistivity material, which offers an advantage of strand size smaller than that which can be achieved in metal. Thus, the many small strands of conductor 1 could naturally be arranged peripherally around the single (or fewer) large strands of conductor 2. High frequencies would tend to stay on the outer skin of conductor 2, where they would be nearest to conductor 1, thereby desirably minimizing the series inductance of conductor 2 at high frequencies.

Most applications involve circuits more complex than shown here, and for such circuits it might be more complex to determine which path links involve forward path conductors and which involve return path conductors, in order thereby to determine where to employ high resistivity versus low resistivity materials for each link as suggested by the present invention. The teachings of the present invention suggest that one possible guide is to employ a low resistivity material wherever a common reference baseline link is required or appropriate (e.g. as a common ground for the circuit)—and to employ a high resistivity material elsewhere (provided that its higher resistance can be worked into the circuit design; if not, a low resistivity material can be employed for this link, possibly combined with a high resistivity material to make a combined material conductor or conductor set). In any case, the present invention encompasses any combination of low and high resistivity materials, so long as both are employed somewhere, anywhere as conductors in or for a complete electric circuit.

It is understood that the present invention also encompasses the above designs as embodied in means, for carrying electric current or voltage or signals, that take a form other than cables. The means encompassed by the present invention include any form known to the art. For example, conductor 1 could take the form of printed circuit traces employing high resistivity material, while conductor 2 could take the form of printed circuit traces (including ground planes) employing low resistivity material. Conductor 2 could be implicit in ways known to the art, for example taking the form of a chassis used as a common reference baseline for part or all of a circuit.

It is understood that there is no upper limit to the resistivity of the high resistivity material encompassed by the present invention for use in at least one of the conductors.

Although the present invention has been described in considerable detail in the above specification, it is not intended that the invention be limited to such detail except as necessitated by the appended claims or their legal equivalent.

I claim:

1. A structure for carrying an electrical current or voltage or signal, said structure comprising a first conductor and a second conductor, said first conductor and said second conductor being adaptable for carrying the forward and return paths for said electrical current or voltage or signal, said first conductor being separated from said second conductor by a distance greater than zero, said first conductor and said second conductor being distinct from any shielding means;

the improvement comprising the composition of said first conductor and said second conductor, said first conductor employing a high resistivity material, and said second conductor employing a low resistivity material, the resistivity of said high resistivity material at 20 degrees Celsius being at least 10 times greater than the resistivity of said low resistivity material at 20 degrees Celsius.

2. The structure of claim 1 wherein said structure comprises an electrical cable.

3. The structure of claim 1 wherein said first conductor comprises a plurality of conductive means, where at least one of said conductive means employs said high resistivity material.

4. The structure of claim 1 wherein said first conductor employs said high resistivity material and does not employ said low resistivity material.

5. The structure of claim 1, further including a shielding means, where said first conductor is distinct from said shielding means and said second conductor is distinct from said shielding means.

6. The structure of claim 1, further including a shielding means, where at most one of the opposite ends of said first conductor is connected to said shielding means and at most one of the opposite ends of said second conductor is connected to said shielding means.

7. The structure of claim 1 wherein said first conductor is made in any physical shape or form known to the art.

8. The structure of claim 1 wherein said second conductor is made in any physical shape or form known to the art.

9. A larger structure comprising the structure of claim 1, further including a further conductor or conductors, said further conductor or conductors being adaptable for carrying electrical current or voltage or signal, where a first predetermined number of distinct conductors, from among the total number of distinct conductors in said larger structure, is provided, comprising numerically at least one distinct conductor for each forward current path or voltage or forward signal path, of the distinct electrical currents or voltages or signals to be carried by said larger structure, and a second predetermined number of distinct conductors, from among said total number of distinct conductors in said larger structure, is provided, for carrying the return current path or common reference baseline or return signal path, of said distinct electrical currents or voltages or signals to be carried by said larger structure, where said second predetermined number is less than said first predetermined number, whereby the number of distinct conductors provided for carrying the forward current path or the voltage or the forward signal path, for electrical currents or voltages or signals, is greater than the number of distinct conductors provided for carrying the return current path or the common reference baseline or the return signal path, for electrical currents or voltages or signals.

10. The structure of claim 1 wherein a plurality of said first conductors are provided and are arranged around the periphery of at least one of said second conductors.

11. The structure of claim 1 wherein the resistivity of said first conductor at 20 degrees Celsius is at least 10 times greater than the resistivity of said second conductor at 20 degrees Celsius.

12. A method for carrying an electrical current o voltage or signal, and obtaining the advantages of high resistivity materials, in combination with the advantages of low resistivity materials, said method comprising the step of providing a first conductor that employs a high resistivity material, and the step of providing a second conductor that employs a low resistivity material, said first conductor and said second conductor being adaptable for carrying the forward and return paths for said electrical current or voltage or signal, said first conductor being separated from said second conductor by a distance greater than zero, said first conductor and said second conductor being distinct from any shielding means;

the resistivity of said high resistivity material at 20 degrees Celsius being at least 10 times greater than the resistivity of said low resistivity material at 20 degrees Celsius.

13. The method of claim 12 wherein said first conductor comprises a plurality of conductive means, where at least one of said conductive means employs said high resistivity material.

14. The method of claim 12 wherein said first conductor employs said high resistivity material and does not employ said low resistivity material.

15. The method of claim 12, further including the added step of providing a shielding means, where said first conductor is distinct from said shielding means and said second conductor is distinct from said shielding means.

16. The method of claim 12, further including the added step of providing a shielding means, where at most one of the opposite ends of said first conductor is connected to said shielding means and at most one of the opposite ends of said second conductor is connected to said shielding means.

17. The method of claim 12 wherein said first conductor is made in any physical shape or form known to the art, and said second conductor is made in any physical shape or form known to the art.

18. The method of claim 12 further including the added step of providing a further conductor or conductors, said further conductor or conductors being adaptable for carrying electrical current or voltage or signal, where at least one of said further conductor or conductors is provided, for carrying the forward current path or the voltage or the forward signal path, for each of any distinct electrical currents or voltages or signals to be carried by said further conductor or conductors, and one conductor is provided as a common conductor for carrying the return current path or the common reference baseline or the return signal path, for a plurality of distinct electrical currents or voltages or signals, whereby the number of distinct conductors provided for carrying the forward current path or the voltage or the forward signal path, for electrical currents or voltages or signals, is greater than the number of distinct conductors provided for carrying the return current path or the common reference baseline or the return signal path, for electrical currents or voltages or signals.

19. The method of claim 12 wherein a plurality of said first conductors are provided and are arranged around the periphery of at least one of said second conductors.

20. The method of claim 12 wherein the resistivity of said first conductor at 20 degrees Celsius is at least 10 times greater than the resistivity of said second conductor at 20 degrees Celsius.

* * * * *